US007422143B2

(12) United States Patent
Mayer

(10) Patent No.: US 7,422,143 B2
(45) Date of Patent: Sep. 9, 2008

(54) CONTAINER HAVING PASSIVE CONTROLLED TEMPERATURE INTERIOR

(75) Inventor: William N. Mayer, White Bear Lake, MN (US)

(73) Assignee: Minnesota Thermal Science, LLC, Plymouth, MN (US)

( * ) Notice: Subject to any disclaimer, the term of this patent is extended or adjusted under 35 U.S.C. 154(b) by 882 days.

(21) Appl. No.: 10/411,847

(22) Filed: Apr. 11, 2003

(65) Prior Publication Data

US 2004/0079794 A1 Apr. 29, 2004

Related U.S. Application Data

(63) Continuation-in-part of application No. 10/278,662, filed on Oct. 23, 2002.

(51) Int. Cl.
*B65D 81/38* (2006.01)
*F25D 3/06* (2006.01)

(52) U.S. Cl. ..... 229/103.11; 62/457.1; 220/592.2; 220/592.25; 220/592.26

(58) Field of Classification Search ..... 229/103.11; 62/457.1, 457.8; 220/592.09, 592.2, 592.25, 220/592.26
See application file for complete search history.

(56) References Cited

U.S. PATENT DOCUMENTS

| | | | | |
|---|---|---|---|---|
| 2,496,296 | A | 2/1950 | Lobl | |
| 3,974,658 | A | 8/1976 | Starrett | |
| 4,145,895 | A | 3/1979 | Hjertstrand | |
| 4,319,629 | A * | 3/1982 | Hotta | 62/457.2 |
| 4,324,111 | A * | 4/1982 | Edwards | 62/457.4 |
| 4,688,398 | A * | 8/1987 | Baek | 62/457.2 |
| 4,877,128 | A | 10/1989 | Strickland | |
| 4,892,226 | A * | 1/1990 | Abtahi | 62/457.1 |
| 4,923,077 | A | 5/1990 | Van Iperen | |
| 4,931,333 | A | 6/1990 | Henry | |
| 5,050,387 | A | 9/1991 | Bruce | |
| 5,088,301 | A | 2/1992 | Piepenbrink | |
| 5,435,142 | A | 7/1995 | Silber | |
| 5,562,228 | A | 10/1996 | Ericson | |
| 5,582,343 | A * | 12/1996 | Dalvey | 62/457.5 |
| 5,758,513 | A | 6/1998 | Smith | |
| 5,899,088 | A | 5/1999 | Purdum | |
| 5,924,302 | A * | 7/1999 | Derifield | 62/457.2 |
| 6,209,343 | B1 | 4/2001 | Owen | |
| 6,223,551 | B1 | 5/2001 | Mitchell | |
| 6,233,965 | B1 | 5/2001 | Choy | |
| 6,250,104 | B1 * | 6/2001 | Bostic | 62/457.4 |
| 6,266,972 | B1 | 7/2001 | Bostic | |
| 6,457,323 | B1 * | 10/2002 | Marotta | 62/457.2 |
| 6,474,095 | B1 | 11/2002 | Chan | |
| 6,502,417 | B2 * | 1/2003 | Gano, III | 62/457.2 |
| 6,718,776 | B2 | 4/2004 | Wessling et al. | |
| 2002/0050147 | A1 * | 5/2002 | Mai et al. | 62/457.2 |

* cited by examiner

*Primary Examiner*—Gary E Elkins
(74) *Attorney, Agent, or Firm*—Sherrill Law Offices, PLLC

(57) ABSTRACT

An apparatus for shipping articles under controlled temperature conditions, having a metallic article enclosure surrounded by a set of insulating panels, with a predetermined volume separation between the enclosure and the insulating panels, and the predetermined volume being filled with phase change material.

3 Claims, 2 Drawing Sheets

CONTAINER HAVING PASSIVE CONTROLLED TEMPERATURE INTERIOR

BACKGROUND OF THE INVENTION

This is a continuation-in-part of my prior filed application, entitled "Container Having Passive Controlled Temperature Interior, and Method of Construction," Ser. No. 10/278,662, filed Oct. 23, 2002.

The shipment of temperature-sensitive goods is extremely difficult when the shipping container itself is not independently temperature-controlled; ie, does not have an independent power source for maintaining interior temperatures within close parameters. Of course, if it is merely desired to maintain an object to be shipped at a nominally cooled temperature—relative to the ambient exterior temperature—a common practice is to pack a shipping container with ice, and hope that the ice will remain in a frozen state during transit so that the object shipped will arrive at its destination still cooled below ambient temperature. This can be an adequate technique for shipping objects where temperature control is not critical. However, even in this case, the temperatures at different points inside the shipping container will vary widely, with parts of the interior of the container becoming quite cool and other parts of the interior warming to various degrees, depending on time and the distance and spatial relationship of the shipped object to the cooling ice which remains in the container.

In shipping objects for which the ambient temperature is expected to be cooler than the desired temperature for the object, the common practice is to place the warmed object inside a container having insulated walls, and then to hope the shipping time is shorter than the time for the heat inside the container to escape through the insulated walls.

A need exists for a passive, reliable and relatively inexpensive way to protect highly temperature-sensitive products and materials. Such products and materials are usually fairly high in value and may be extremely temperature-sensitive. Some examples of such products or materials are blood shipped or carried to remote battle zones, sensitive pharmaceuticals shipped between plants or to distributors, HIV vaccines shipped to third world countries, and medical instruments shipped to, or kept in readiness at, remote stations or in emergency vehicles. In such cases the ambient temperatures may vary widely, from extremely hot shipping facilities in the southern states to receiving points in cold, mountainous regions of the world in midwinter.

In the prior art temperature control of shipped products or materials has been at least partially achieved by using containers lined with insulating panels on all six outer wall surfaces, and then including in the container with the product or material a pack or package of material which acts as either a heat sink (ie., ice) or heat source (ie., water), depending on whether the container is expected to encounter higher or lower ambient temperatures during shipment. The required wall thickness of the insulated container walls, and the volume of heat sink, or heat source, material can be approximately empirically determined by testing, to identify an expected average interior temperature dependent on choice of materials, wall thickness, expected ambient temperatures during shipment, and time of shipment. However, this testing cannot reliably identify the range of internal temperatures which might be encountered, which depend upon the spatial relationship between the internal shipped object and the various other factors described above.

SUMMARY OF THE INVENTION

The present invention comprises a container for shipping temperature sensitive products or materials, having outer walls constructed of thermal insulating material, and an inner liner of highly heat-conductive material, the inner liner being sized so as to provide some volume separation between its walls and the thermal insulating walls of the container, the volume between the thermal insulating walls and the inner liner being filled with an appropriate phase change material as described herein.

It is a principal object of the invention to provide a shipping container having an extremely closely-controlled interior temperature throughout the inner liner interior volume, for the time required.

It is a further object of the invention to provide a shipping container having close interior temperature control, and which is inexpensive to make.

DESCRIPTION OF THE PREFERRED EMBODIMENT

Figure 1:
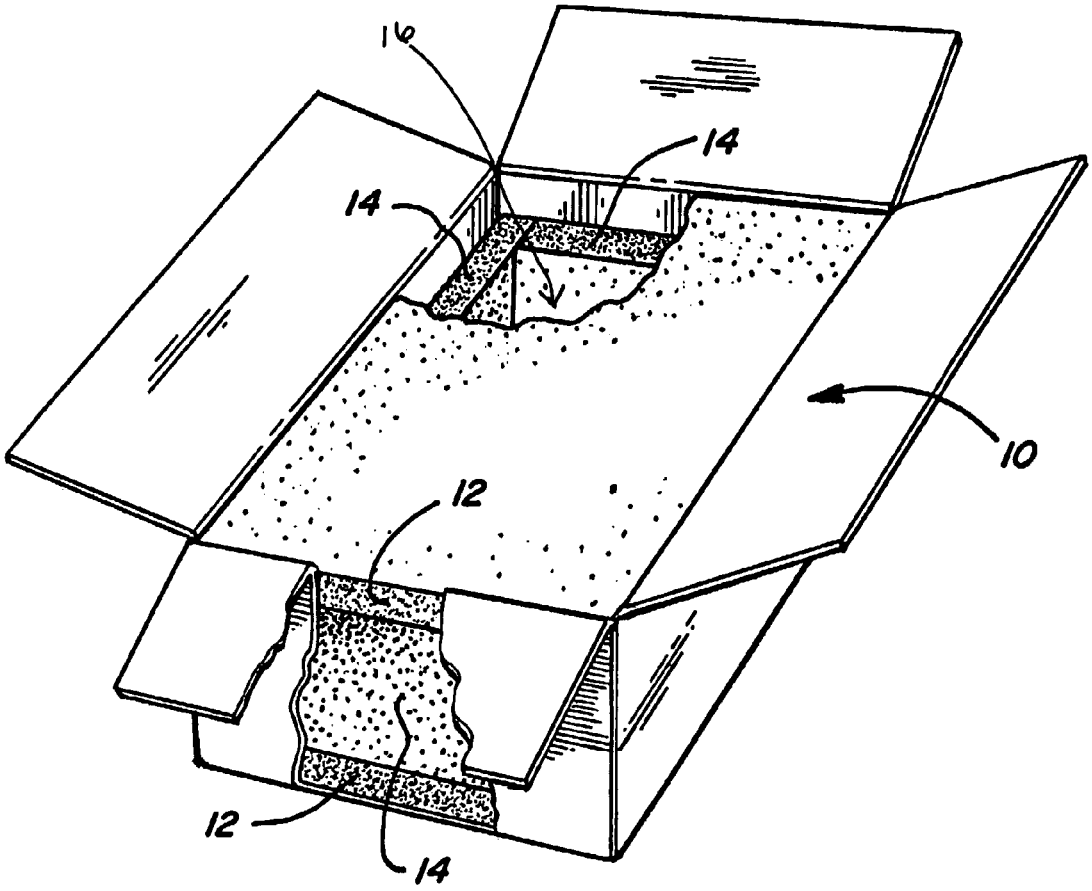
FIG. 1 (PRIOR ART)
FIG. 1 shows an isometric view of a conventional prior art insulated shipping container.

Referring first to FIG. 1, there is shown an insulating container of the type known in the prior art. An outer carton 10 may be made from corrugated cardboard or the like. Inserted snugly into the outer carton 10 is a top and bottom insulating panel 12, and four side insulating panels 14. All insulating panels may be constructed of Styrofoam or the like, or any material having good insulation qualities, ie., having a high thermal resistance "R". The article to be shipped is typically placed in the interior volume 16 which is inside the inner insulating panels 14 and the top and bottom insulating panels 12, and then the carton is sealed and shipped. If extra cooling is desired, it may be necessary to also enclose a packet of cooling material such as ice, which gradually melts during the shipping transit time as heat is absorbed into the carton from outside, and the ice is transformed from a solid material to a liquid. It is preferable that the ice be carried inside a waterproof bag or container, to prevent the liquid from escaping into the interior volume.

In the prior art example above, the ice can be referred to as a phase change material (PCM), which is characterized as a material which changes from a solid to a liquid at a "melting point" temperature, or from a liquid to a solid at the same "melting point" temperature, as thermal energy is either absorbed or released by the PCM, thus acting as a heat source or heat sink, depending on the circumstances.

Most solids are characterized by crystalline form, wherein the angles between adjoining faces are definite for a given type of crystal, and cleavage planes exist along which the crystal may be split. The structure is made up of units (molecules, atoms or ions) arranged in a fixed, symmetrical lattice, the shape of which is dependent on the size and arrangement of the underlying units which are packed together. As a solid, the underlying molecules or other constituents are no longer able to move freely, as they are in the gaseous or liquid states.

When a crystalline solid is heated to a fixed temperature, it melts, or changes to a liquid. The "melting point" is a definite temperature for a given substance, and may be defined as "the temperature at which the solid and liquid are in equilibrium." For example, if the substance is a mixture of water and ice, at its melting point (0° C.), the ice and water remain in contact, with no tendency for one state to change to the other. This is the only temperature at which this condition exists; at temperatures above it the substance becomes liquid water, and at temperatures below it the substance becomes ice.

At the melting point temperature, the vapor pressures of the solid and liquid forms of a substance are the same; otherwise, one state would be converted into the other by passing through the gaseous condition. When liquids are cooled to the melting point, and further quantities of heat are removed, generally they freeze, the temperature of the resulting solid, so long as any liquid remains, being the same as that of the liquid. However, if no solid crystals are present and if the liquid is not agitated, the temperature of liquids may be lowered below their normal freezing points without solidifying. These "supercooled" liquids have a higher vapor pressure than the solid form of the substance and hence a condition of equilibrium cannot exist.

Although molecules or other units of solids cannot move freely, nevertheless they possess thermal energy of motion, in the form of vibration about fixed positions in the lattice structure. Heat must be supplied to a solid in order to raise its temperature to the melting point, where it transforms from a solid to a liquid, remaining at the melting point temperature until the transformation is complete. If heat is removed from a liquid, its temperature drops until it reaches the melting point, and the liquid remains at the melting point temperature until it becomes transformed into a solid. Increase of temperature causes the molecules to vibrate more and more, until, at the melting point, this motion overcomes the binding forces in the crystal and the substance gradually passes into the liquid state. Therefore, a definite amount of heat, called the "heat of fusion", is required to separate particles from the crystal lattice. The "heat of fusion" is defined as the amount of heat (in calories) required to change one gram of the solid to a liquid, at the melting point. For ice, the heat of fusion is 79 calories (144 Btu/pound).

In the illustration of FIG. 1, if it were desired to ship an article in an insulated package such as the one shown, and assuming it were necessary to maintain the article at a temperature below the expected ambient temperature to be encountered along the shipping route, it would be the normal practice to place the article and a packet of ice into the container and then ship it. The amount of ice required, and the size of the shipping container, would be estimated, depending upon the shipping time and the expected ambient temperature along the route, it being hoped that the article would arrive at its destination still cooled to a reasonable temperature below ambient.

The uncertainties of the foregoing example are evident, although the technique is commonly used when maintaining the temperature of the article is not critical, or when the article is sufficiently inexpensive to not require better handling. Other difficulties exist with the common technique; for example, the distribution of temperatures within the container is highly nonuniform. This is because the thermal flux entering the container flows from the outside ambient to the PCM over many different paths. After flowing through the outside insulating panels, the heat flux flows along various paths through the air inside the container, each path having a different thermal resistance "R" depending upon path length, leading to a different thermal gradient from the insulating walls to the article inside the container. Therefore, some parts of the article shipped may be at one temperature and other parts may be at some other temperature. In particular, if the shipped article is placed atop a packet of ice, the underside of the article may be quite cool while the upper portions of the article may be excessively warm.

Figure 2:
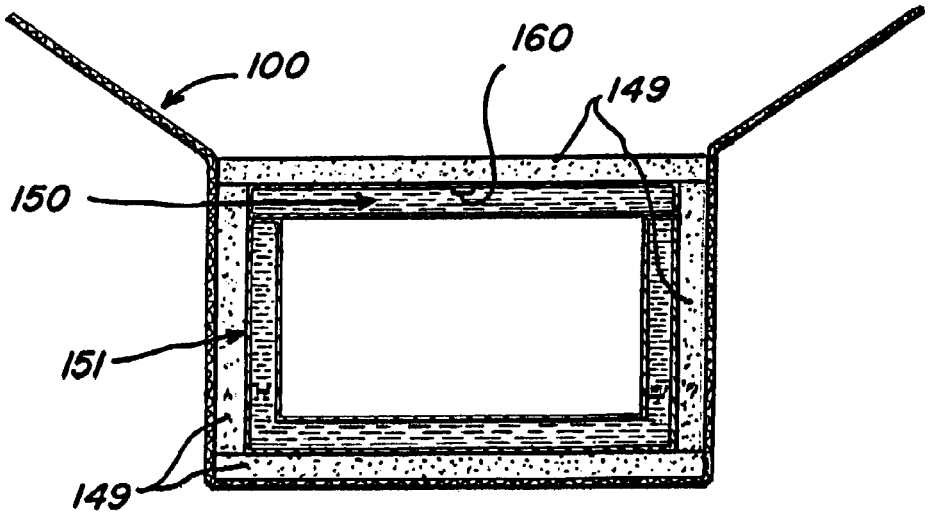
FIG. 2 shows a side cross section view of one form of construction for the present invention.

FIG. 2 shows a cross-section view of a shipping container which alleviates the problems described with reference to the prior art. In this drawing, an outer carton 100 may be made from corrugated cardboard or similar material. A plurality of insulated panels 149 line the interior walls of carton 100, wherein these panels may be made from styrofoam material or some similar material having a relatively high thermal resistance.

A plurality of hollow panels or chambers 151 are positioned inside the insulated panels 149. These hollow panels may be formed of a single hollow housing having a sealed bottom and side walls, and a top hollow panel 150, or they may be formed of sealed hollow side panels 151 positioned adjacent a sealed hollow bottom panel 150, with a further sealed hollow top panel 150 sized to fit over the side panels. If the structure is not rectangular or box-shaped, the walls and panels obviously must be shaped to conform to the shape of the structural walls.

For each separate hollow panel 150, 151, it is important to provide a vent relief hole 160 into the panel, which may be done by providing a hole of approximately ¼ inch covered with a material such as TYVEK® which is a material which passes air but is impervious to water or other similar liquids. TYVEK is a registered trademark of EI Dupont Nemours Co.

The interior walls of the hollow panels or chambers, or at least some of the interior walls, are preferably coated with a material such as aluminum oxide, in the case of using water as the PCM, so as to promote the formation of ice crystals at the freezing point. A material such as aluminum oxide has an irregular, crystalline surface which promotes crystal formation in a liquid such as water. In general, the interior side walls should be at least partially coated with a non-soluble crystalline material which will promote the formation of crystals in the phase change material; ie., aluminum oxide for water and ice. The non-soluble crystalline material should be coated on at least the side walls in the vicinity of the top surface of the liquid, so that when the freezing point is reached the formation of ice crystals readily occurs at the freezing point and where the liquid is at its coldest level.

With the foregoing structure, thermal flux enters the carton through the corrugated outside walls, and is attenuated through the insulated interior panels. It is presumed that the PCM filling the interior hollow panels or chambers is initially converted to a solid such as ice. The thermal flux engages the PCM and causes a gradual phase change of the solid into a liquid at the melting point of the solid. All volumes inside the hollow chambers filled with PCM remain at the melting point of the solid contained within the hollow chambers; therefore, the article being shipped and all regions on the inside of the package remain at the melting point of the PCM. In the case of water/ice, the melting point is approximately 0° C., and therefore the interior temperature will remain at 0° C. for so long as it takes for all the ice to convert to water (144 Btus per pound).

It is possible to calculate the amount of phase change material required for a given size package, over a predetermined time, with a predetermined thickness of insulating material and a known ambient temperature, with the following formula:

Btu's=(shipping time in hours)(internal area of insulating material)(differential temperature in ° F.)/(thickness of insulating material)(Thermal conductance of insulating material)

From the foregoing formula the amount of heat required to be absorbed by the PCM is determined. The amount of PCM can then be calculated as:

Weight of PCM in pounds=(#Btu's)/(heat of fusion)

After the weight of PCM has been determined, it can be calculated how much volume of hollow chamber is required to contain this weight of PCM. If this calculation yields a volume which is greater than volume assumed in the initial calculations, it is necessary to repeat the calculations with a new assumed volume, until the calculated volume is in approximate agreement with the volume initially assumed, through an iterative process.

The following example illustrates the technique for calculating the size carton required for a predetermined size article to be shipped:

Initial Assumptions:

the required volume of the article is 7"×7"×7";

each wall thickness of the hollow chamber housing is 0.030 in;

the hollow chamber interior width is 1"−0.060"=0.94";

the permissible temperature extremes of the article are 28° F.-36° F.;

the ambient temperature is 112° F.;

the choice of PCM is ice;

1 pound of ice=1 pound of water=28.8 cubic inches;

the heat of fusion of water=144 Btu's/pound;

the required shipping time is 120 hours;

80% of the hollow chamber volume is filled with water, to allow room for expansion as the water freezes;

the thermal resistance of the insulation is R=30;

Calculations:

calculating the total internal area of the insulation panels, we obtain 384 sq. in.=2.67 sq. ft.;

calculating the volume of the insulating walls, we obtain 384×0.94=361 cu. in.;

calculating the volume of the hollow chambers 80% filled with the PCM, we obtain V=361×0.8=290 cu. in.;

calculating the volume needed to fit the assumed parameters, we obtain V=(cu. in/pound)(diff.° F./in.)(time)(insulation inside area)/(insulation thermal resistance)(heat of fusion per pound)(insulation thickness)=(28.8)(112−31)(120)(2.67)/(30)(144)(1)=173 cu. in.

We calculate the available volume to be 290 cu. in., which is more than sufficient to provide the results wanted; the calculation could be repeated with different assumptions to more closely match the required volume (173 cu. in.) With the available volume (290 cu. in.), or the assumptions can be left alone, which will result in the carton being able to provide the desired cooling protection for more than 120 hours.

There are alternative constructions which are available for the invention, particularly the hollow chamber which surrounds the space for receiving the article to be shipped. For example, the embodiment shown in FIG. 2 could have some or all of the side walls and base layer formed of a single hollow shell, with a separate top cover formed of a hollow panel.

Alternatively, the side walls, top and bottom layers could be constructed of independent hollow panels which are closely fitted together to form the hollow enclosure for the shipment article. As a further alternative, a hollow, flexible rectangular tube could be shaped to form the four walls of the enclosure, with a separate hollow top panel and bottom panel, or several hollow tubes could be shaped into a "U-shape" and fitted together orthogonally to form the enclosure.

Figure 3:
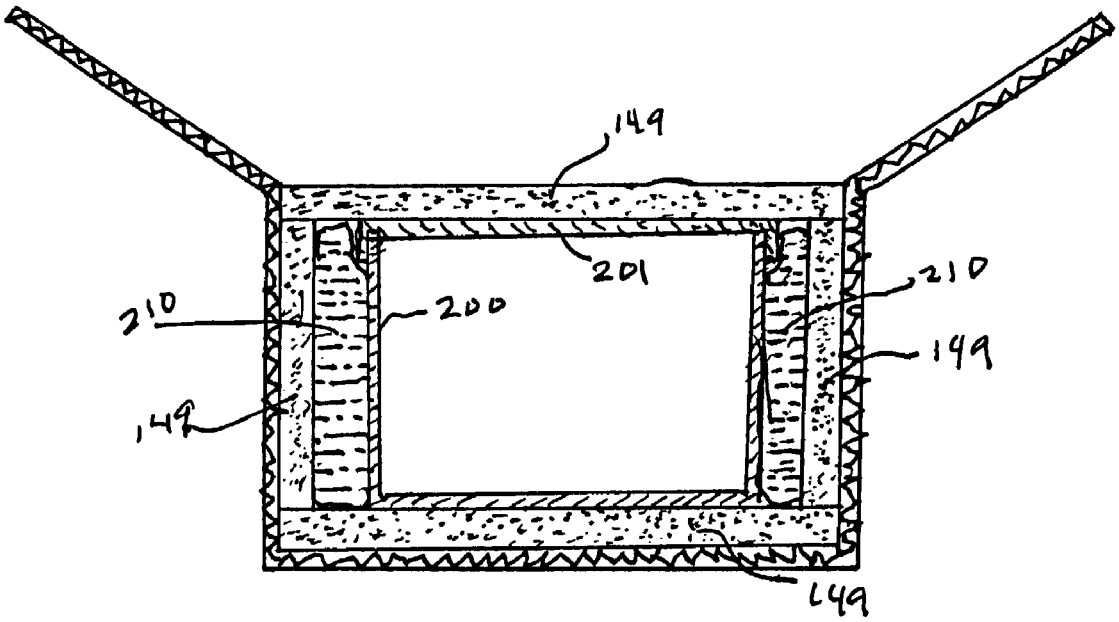
FIG. 3 shows a side cross section view of the preferred form of the present invention.

Another alternative construction is shown in FIG. 3, which is a variation having a rectangular, single-walled structure 200, with a top cover 201, placed inside the insulated outside walls 149. The material of the single-walled structure 200 and the top cover 201 has a high thermal conductance, and is preferably made from a heat-conductive metal such as copper or aluminum. The internal structure 200 is sized to provide a volumetric space between it and at least some of the outside insulated walls 149, and this volumetric space is filled with flexible containers 210, such as plastic bags, filled at least partially with a PCM material such as water and/or ice. The volumetric space may be created between any one or more of the metal single walled container walls, or between the metal cover, or between the metal container bottom surface, and any one or more of the insulated outside walls. However, at least one metal container surface must be in contact with the PCM package. In this case, the heat of fusion is transferred to and from the interior of the single-walled structure uniformly because of the high heat conductance of the construction materials of the metal walls.

In all cases of construction, it should be kept in mind that hollow, sealed panels or bags may need to have a pressure relief vent if the material cannot withstand the different ambient pressures which might be encountered. Such relief vents can be constructed in many ways, one of the simplest being to provide a hole through the hollow walls, with a covering layer of TYVAK or similar material which passes air but blocks liquid from flowing through the hole.

The embodiment of FIG. 3 is particularly useful when the heat of fusion of the internal volume contents is desirably the same as for a mixture of water and ice, for the structure provides a very economical solution to the problem of maintaining interior temperature for a considerable length of time. It is very easy to construct the embodiment of FIG. 3 for a modest cost. In particular, it is not necessary for all interior walls of the insulating panels and exterior walls of the metal container to be separated by a volume of PCM-containing material; it is sufficient if only several walls be so constructed, to achieve the degree of temperature stabilization desired in any particular application.

It is not necessary to use only water and ice as the PCM for the operation of the invention. Other materials having different melting points are useful if the set point temperature desired to be maintained inside the container is higher or lower than 0° C. For example, deuterium oxide ($D_2O$) has melting point of 3.6° C. Furthermore, other materials, such as salts or antifreeze, may be mixed with water to provide a PCM having a controllable but different melting point.

The present invention may be embodied in other specific forms without departing from the spirit or essential attributes thereof; and it is, therefore, desired that the present embodiment be considered in all respects as illustrative and not restrictive, reference being made to the appended claims rather than to the foregoing description to indicate the scope of the invention.

What is claimed is:

1. An apparatus for shipping an article under controlled temperature conditions, comprising:

(a) a first volume sized for containment of said article, and a first enclosure surrounding said first volume; said first enclosure having a heat-conductive walled construction with a removable cover;

(b) a plurality of insulating walls about said first enclosure in spaced apart relationship and arranged to form a cubic second enclosure about said first enclosure, at least one of said plurality of insulating walls being removable to provide access to the interior of said first enclosure;

(c) a package filled with phase change material placed in the space between said insulating walls and said first enclosure, and (d) a third enclosure surrounding said plurality of insulating walls comprising a cardboard shipping carton.

2. The apparatus of claim 1, wherein said phase change material further comprises a mixture of water and ice.

3. The apparatus of claim 2, wherein said first enclosure is made from metallic material.

* * * * *

US007422143C1

(12) EX PARTE REEXAMINATION CERTIFICATE (9600th)

United States Patent
Mayer

(10) Number: US 7,422,143 C1
(45) Certificate Issued: Apr. 15, 2013

(54) CONTAINER HAVING PASSIVE CONTROLLED TEMPERATURE INTERIOR

(75) Inventor: William N. Mayer, White Bear Lake, MN (US)

(73) Assignee: Minnesota Thermal Science, LLC, Bloomington, MN (US)

Reexamination Request:
No. 90/009,990, Apr. 2, 2012

Reexamination Certificate for:

| | |
|---|---|
| Patent No.: | **7,422,143** |
| Issued: | **Sep. 9, 2008** |
| Appl. No.: | **10/411,847** |
| Filed: | **Apr. 11, 2003** |

Related U.S. Application Data

(63) Continuation-in-part of application No. 10/278,662, filed on Oct. 23, 2002, now Pat. No. 7,500,593.

(51) Int. Cl.
*B65D 81/38* (2006.01)
*F25D 3/06* (2006.01)

(52) U.S. Cl.
USPC ..... 229/103.11; 220/592.2; 220/592.25; 220/592.26; 62/457.1

(58) Field of Classification Search ..... None
See application file for complete search history.

(56) References Cited

To view the complete listing of prior art documents cited during the proceeding for Reexamination Control Number 90/009,990, please refer to the USPTO's public Patent Application Information Retrieval (PAIR) system under the Display References tab.

*Primary Examiner* — Patricia Engle

(57) ABSTRACT

An apparatus for shipping articles under controlled temperature conditions, having a metallic article enclosure surrounded by a set of insulating panels, with a predetermined volume separation between the enclosure and the insulating panels, and the predetermined volume being filled with phase change material.

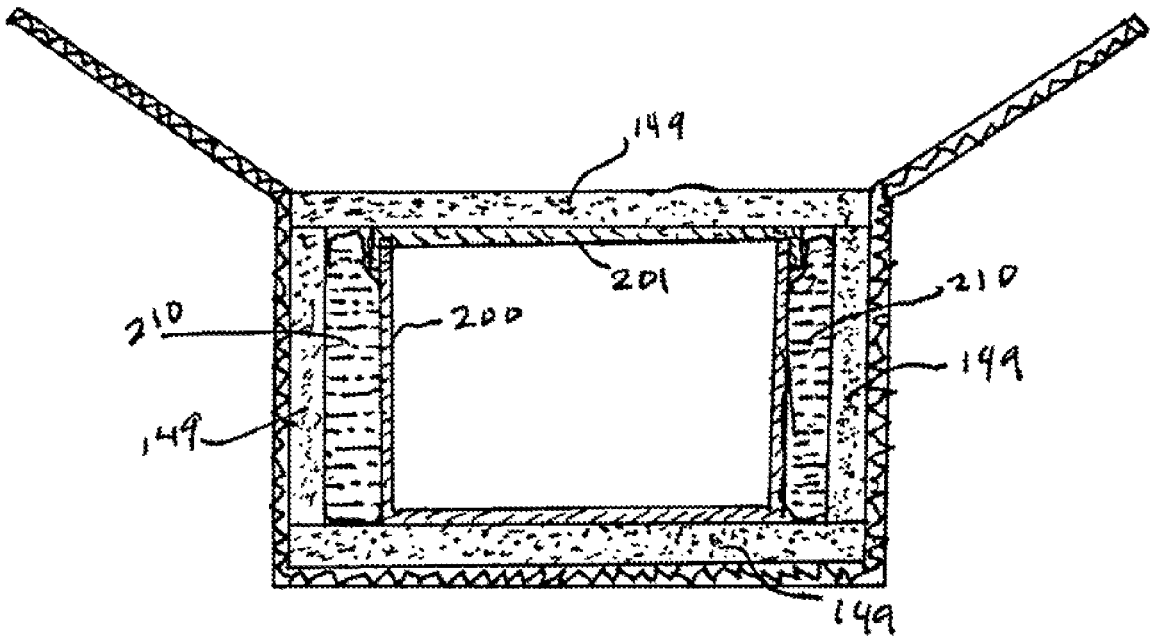

EX PARTE REEXAMINATION CERTIFICATE ISSUED UNDER 35 U.S.C. 307

THE PATENT IS HEREBY AMENDED AS INDICATED BELOW.

AS A RESULT OF REEXAMINATION, IT HAS BEEN DETERMINED THAT:

Claims 1-3 are cancelled.

* * * * *